US005593345A

United States Patent [19]

Johnson

[11] Patent Number: 5,593,345

[45] Date of Patent: Jan. 14, 1997

[54] ABRASIVE-BELT CONVERSION WHEEL FOR CYLINDRICAL GRINDERS

[76] Inventor: James N. Johnson, 15 S. Worthington St., Youngstown, Ohio 44502

[21] Appl. No.: 596,771

[22] Filed: Feb. 5, 1996

[51] Int. Cl.[6] ..... B24B 21/00

[52] U.S. Cl. ..... 451/296; 451/303; 451/488; 451/311; 451/505; 451/513

[58] Field of Search ..... 457/296, 541, 457/538, 539, 504, 505, 513; 957/458, 311, 513, 303

[56] References Cited

U.S. PATENT DOCUMENTS

| | | | |
|---|---|---|---|
| 3,145,709 | 9/1964 | Bass et al. . | |
| 3,611,535 | 10/1971 | Guenther . | |
| 4,119,032 | 10/1978 | Hollis . | |
| 4,144,812 | 3/1979 | Julian . | |
| 4,189,872 | 2/1980 | Evans | 451/488 |
| 4,231,193 | 11/1980 | Siegel | 451/311 |
| 4,292,767 | 10/1981 | Fatula . | |
| 4,316,349 | 2/1982 | Nelson . | |
| 4,575,972 | 3/1986 | Ohki et al. . | |
| 4,682,444 | 7/1987 | Judge et al. . | |
| 4,796,387 | 1/1989 | Johnson . | |
| 5,184,424 | 2/1993 | Miller . | |
| 5,230,456 | 7/1993 | Germann et al. . | |
| 5,232,141 | 8/1993 | Mittmeyer et al. . | |
| 5,339,570 | 8/1994 | Amundson et al. | 451/303 |
| 5,351,447 | 10/1994 | Grauert | 451/505 |

FOREIGN PATENT DOCUMENTS

| | | | |
|---|---|---|---|
| 559229 | 9/1932 | Germany | 451/504 |
| 355031558 | 3/1980 | Japan | 451/504 |

*Primary Examiner*—Robert A. Rose
*Assistant Examiner*—George Nguyen
*Attorney, Agent, or Firm*—Robert J. Herberger, Esquire

[57] ABSTRACT

A conversion grinding wheel frame for an abrasive-belt to secure thereto for replacing a conventional stone grinding wheel used on a cylindrical roll grinding machine. The abrasive-belt conversion wheel is secured to a spindle of the grinding machine by a wheel clamping assembly. The abrasive-belt conversion wheel frame having an engagement working surface and a mounting surface with both surfaces having apertures therethrough traversing from a chamber within the abrasive-belt conversion grinding wheel frame. Fluid under pressure in the chamber escapes through the apertures to the working surface and mounting surface. The pressure of the gas expands the abrasive-belt while being mounted onto the abrasive-belt conversion grinding wheel frame. The mounting surface is diametrically tapered in relation to the working surface to afford initial engagement of the abrasive-belt which further assists mounting the abrasive-belt onto the working surface.

12 Claims, 4 Drawing Sheets

ABRASIVE-BELT CONVERSION WHEEL FOR CYLINDRICAL GRINDERS

FIELD OF THE INVENTION

This invention relates to a roll grinding machine and method to surface finish cylindrical parts such as large rollers used in industry and, more particularly, to a grinding wheel frame attached to a spindle of the grinding machine wherein the abrasive-belt conversion grinding wheel having an abrasive-belt mounted thereon replaces the conventional stone grinding wheel.

BACKGROUND OF THE INVENTION

Metal rollers used in industry tend to wear out in certain areas, including their edges, and the roller surface are often roughened so that their surface must be periodically ground or refinished. According to the traditional method, a roller is removed from the rolling mill and it is generally ground or refinished one of three ways: i) using a conventional stone grinding wheel on a roll grinding machine; ii) by using a continuous, abrasive-tape finishing machine; or iii) by using an abrasive-belt finishing machine.

Using the first grinding technic discussed above, a stone grinding wheel is brought against the desired surface to be finished and the stone grinding wheel is caused to rotate against the surface. This possesses a number of significant disadvantages. For instance, due to the requirement that the stone grinding wheel must be soft enough to be self-dressing and to provide the desired material removal characteristics, the stone, through continued use, takes on the shape of the part being finished. Further, it is extremely difficult to find a stone grinding wheel with consistent qualities. This usually causes significant differences in the finished parts when machined by different stones. Another major disadvantage of the grinding machine using a stone grinding wheel is that the wheel has to be rebalanced and adjusted on the spindle of the grinding machine as the stone wheel wears.

As previously stated, the second finishing technic discussed above uses a machine having a continuous abrasive-tape. Using an continuous, abrasive-tape finishing machine, the surface being finished is caused to rotate (unlike the conventional grinding machine using a stone wheel where the grinding wheel is rotated). As the part is rotated, the tape is released from a tape cassette or spool and the tape is bought into contact with the surface to be finished by pressure exerted by compression rollers or platens.

Although this finishing equipment provides a more reliable and consistent finish because of the consistency with abrasive-belts, it to has its disadvantages. One of the disadvantage is the waste associated therewith. An abrasive-tape grinding machine is continuously fed from an abrasive-tape cassette such as that taught by Ohki, et al., U.S. Pat. No. 4,575,972, and by Johnson, U.S. Pat. No. 4,796,387. As a result, the abrasive-tape only comes in contact with the working surface once during the grinding process before it is discarded,. thereby causing waste and increase cost of the finishing process.

Finally, the third finishing technic uses an abrasive-belt (instead of abrasive-tape) which may overcome the waste problem, yet has other disadvantages. For example, these machines typically have a uniquely design, whereby it only uses a particular diameter abrasive-belt configured over multiple rollers which mechanically apply pressure against the belt as shown by the Nelson patent, U.S. Pat. No. 4,316,349. A major disadvantage with these machines is that they cannot be easily adapted for any other abrasive-belt configuration and the user is generally confined to depend upon the particular manufacturer of the equipment for replacement abrasive-belts and parts, making the equipment less desireable to the user. Further, these type machines are used typically for grinding non-circular work.

With the advent of improved coatings and adhesives for abrasive-belts, as well as improved grinding abrasive materials such as man-made crystals, refined sands and diamonds, many users owning roll grinding machines would prefer to convert their equipment to take advantage of the consistency of the abrasive-belt versus stone grinding wheel, instead of buying new finishing equipment which would accommodate abrasive-tapes or belts. Yet, such conventional stone grinding machines require a complicated and complex process for conversion, including substantially modifying the existing grinding machine to include a belt guard, guide rollers and compression member or platens typically required. Further, belt grinding attachment conversion kits require additional space which on many conventional stone grinding machines is not available.

Consequently, a need exists for a device to convert a conventional stone grinding machine to take advantage of the improved reliability, consistency and flexibility of abrasive-belts without requiring major modification to the grinding machine.

SUMMARY OF THE INVENTION

Accordingly, it is an objective of the present invention to provide an abrasive-belt conversion wheel for the traditional roll grinding machine which will easily replace the existing stone grinding wheel. This invention comprising of an abrasive-belt conversion wheel allows traditional roll grinding machines to use abrasive-belts in place of stone grinding wheels without requiring substantial and costly modification to the traditional grinding machine.

The instant invention relates to a method of use and apparatus comprising a spindle for mounting a grinding wheel frame for holding an abrasive-belt. The grinding wheel frame has an outer surface, the outer surface having a working surface and a mounting portion. A wheel clamping assembly is used to hold and balance the grinding wheel frame to the spindle. A plurality of apertures pass laterally through the outer surface of the grinding wheel frame, the apertures being spaced longitudinally and circumferentially along the outer surface. An abrasive-belt being diametrically undersized for the working surface of the grinding wheel frame when in unstressed condition, is stretched when a fluid under pressure, such as compressed gas, is applied to a chamber within the grinding wheel frame. The fluid issues radially outward from the chamber to the outer surface of the grinding wheel frame through said apertures. The escaping fluid helps the abrasive-belt to slide more freely over the mounting portion of the outer surface and onto the working surface. The abrasive-belt securely contracts onto the working surface when the gas pressure is removed. The working surface has a texture having a high friction co-efficient to maximize contact between the grinding wheel frame and the underside of the abrasive-belt once pressure has been removed and the expanded belt resiliently grips the mounting surface.

BRIEF DESCRIPTION OF THE DRAWINGS

These and other features, aspects, and advantages of the present invention may be further understood by reference to the drawings where.

DESCRIPTION OF THE PREFERRED EMBODIMENT

Figure 6:
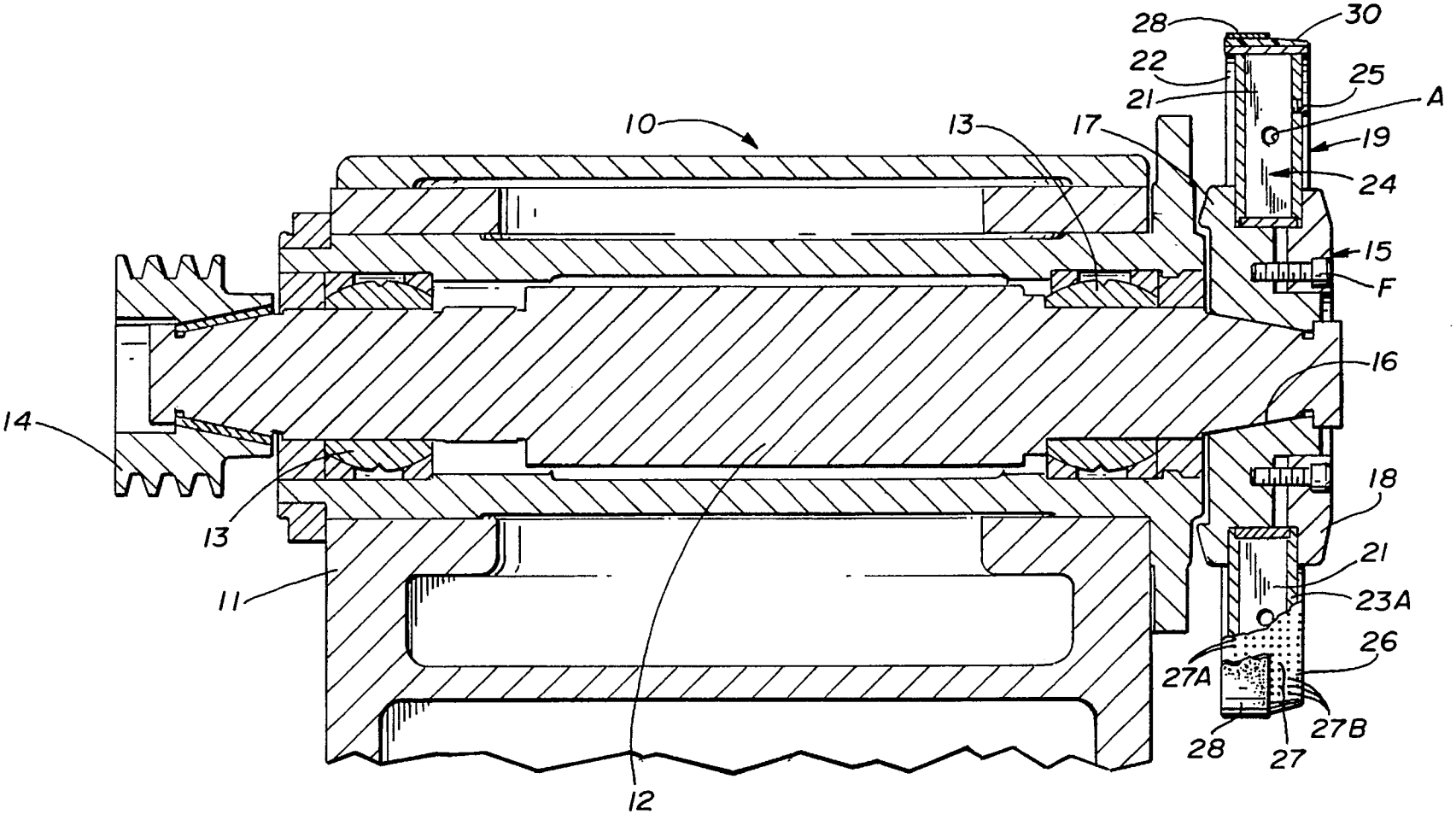
FIG. 6 is a sectional and partial elevational view of a roll grinding machine with the abrasive-belt conversion wheel mounted thereon.

Starting with FIG. 6, a cylindrical roll grinding machine 10 can be seen having a support and mounting frame 11 with a spindle 12 rotatably positioned therein. The spindle 12 is supported on bearing assemblies 13 with a drive pulley fitting 14 on one end thereof. A wheel clamping assembly 15 is supported on the opposite end of the spindle 12.

The wheel clamping assembly 15 is secured to a tapered end portion 16 of the spindle 12 having a grinding wheel frame receiving portion 17 therein. The grinding wheel frame receiving portion 17 has a removable mounting collar 18 for securing an abrasive-belt grinding wheel frame 19 within the wheel clamping assembly 15 by a plurality of threaded fasteners F. More specifically, referring to FIGS. 1 and 3, a wheel mounting area 32 of the grinding wheel frame has a reduced transverse dimension formed along each disk member 23A and 23B, respectively, to permit the registered engagement between the receiving portion 17 and the mounting collar 18 of the wheel clamping assembly 15, as described.

Figure 1:
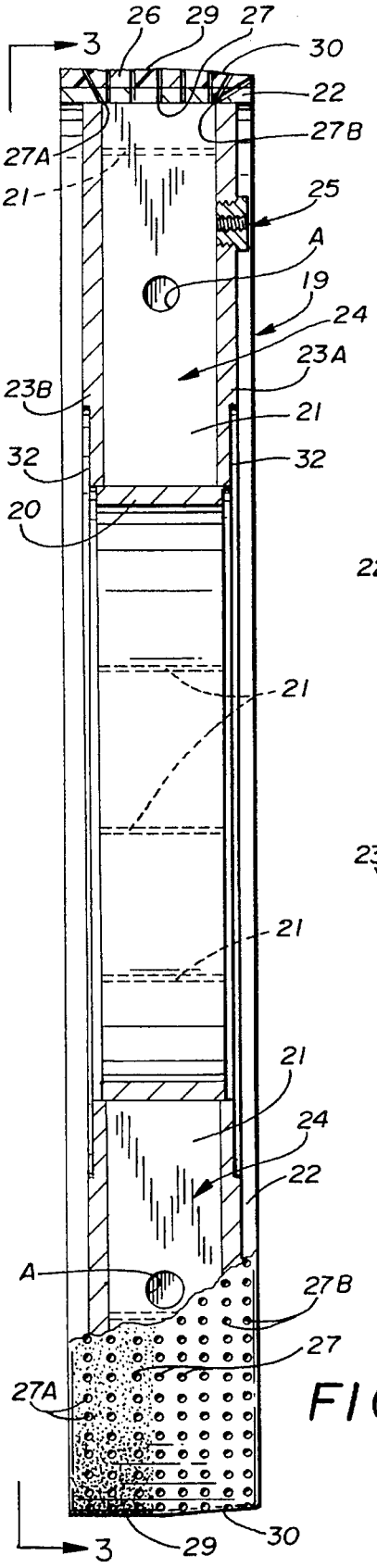
FIG. 1 shows a partial sectional view of the invention on lines 1—1 of FIG. 3.
Figure 3:
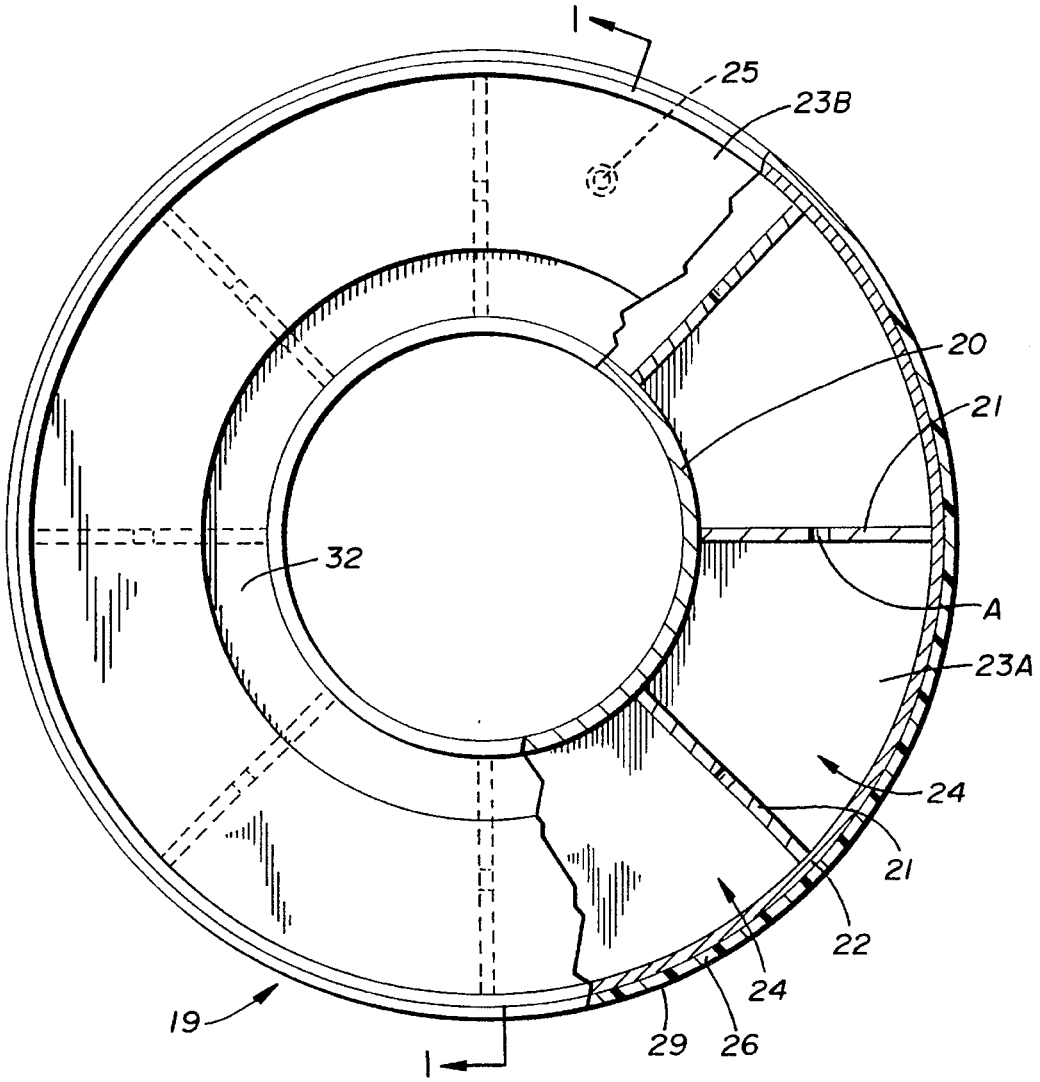
FIG. 3 is an elevational view of the invention with portions broken away illustrating multiple chambers within the grinding wheel frame.

The abrasive-belt conversion grinding wheel frame 19 can be seen having a spindle engagement sleeve 20 with a plurality of radially extending internal ribs 21. An outer surface 22 extends circumferentially about the perimeter edges of the respective ribs 21 as best seen in FIG. 3. Referring to FIG. 1, a pair of oppositely disposed disks members 23A and 23B are secured by casting or welding to the respective free edges of said spindle engagement sleeve 20 and internal ribs 21 and against the outer surface 22.

Turning to FIG. 3, multiple chambers 24 are formed between the plurality of internal ribs 21 which provide reinforcement within the grinding wheel frame. The chambers 24 are in fluid communication with one another by apertures A in each of said respective internal ribs 21. A fluid inlet fitting 25 is connected through disk member 23A wherein fluid, such as compressed air, is supplied to the chambers 24.

Figure 2:
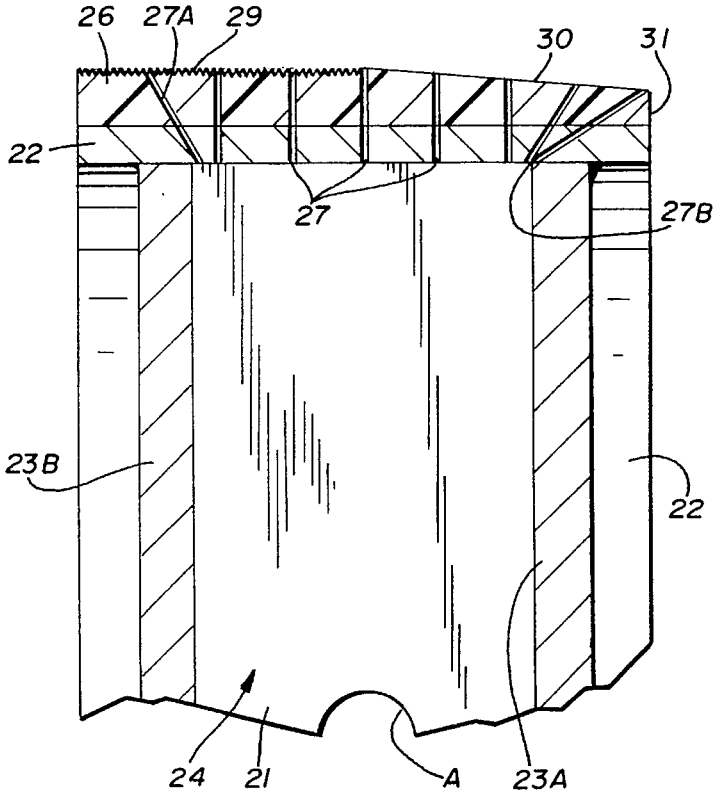
FIG. 2 shows an enlarged cross-sectional view of a portion of the mounting surface and working surface with a plurality of apertures therethrough.

Referring now to FIGS. 1 and 2, a belt engagement layer 26 of synthetic resin material is bonded to the outer surface 22 by casting. The belt engagement layer 26 is marginally resilient having a 70 shore D hardness and in this example is cast urethane. A plurality of apertures 27 pass aligned and laterally through the outer surface 22 of the grinding wheel frame 19 and friction layer 26. The apertures 27 are spaced longitudinally and circumferentially in relation to one another. The frictional layer 26 has a textured working surface 29 and a mounting surface 30.

Figure 4:
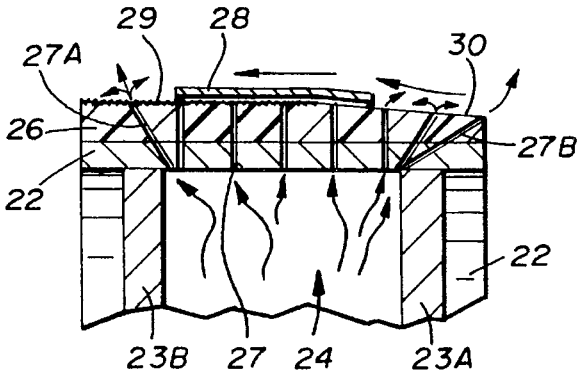
FIG. 4 is an enlarged cross-sectional view of a portion of the mounting and working surfaces of the invention illustrating the mounting of the abrasive-belt thereon.
Figure 5:
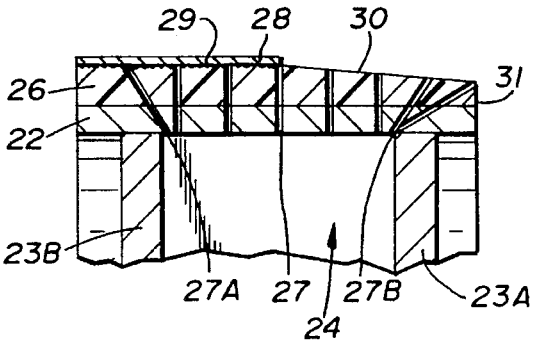
FIG. 5 is an enlarged cross-sectional view of a portion of the mounting and working surfaces with the abrasive-belt positioned thereon for use.

The working surface 29 is the surface to which the abrasive-belt 28 is positioned for use, as illustrated in FIG. 5. Viewing FIGS. 2, 4 and 5, the mounting surface 30 is tapered outwardly from the working surface 29 to its perimeter edge 31 thereby allowing the abrasive-belt 28 to be inserted onto the grinding wheel frame 19. The apertures 27 communicate through the working and mounting surfaces 29 and 30, respectively, to a corresponding chamber 24. The apertures 27A and 27B adjacent the respective perimeter edges of the textured working surface 29 and mounting surface 30 are angularly inclined in relation to the belt engagement layer 26.

Before use, as best seen in FIG. 3, the multiple chambers 24 are pressurized with fluid from a source (not shown), such as compressed air, via the inlet fitting 25. The abrasive-belt 28 is stretched by the pressurized fluid escaping from the apertures 27, 27A and 27B which form a fluid film layer between the bottom of the abrasive-belt 28 and the mounting surface 30, then between the abrasive-belt 28 and working surface 29 as the abrasive-belt 28 is slid around and onto the grinding wheel frame 19. Once the abrasive-belt 28 has been positioned over the working surface 29, the fluid pressure is removed and the abrasive-belt 28 contracts becoming frictionally secured to the working surface 29 of the frictional layer 26 as required for use and shown in FIG. 5.

The abrasive-belt 28 has a stretch co-efficient that is proportional to the diameter differential of the grinding wheel frame 19 between the working surface 29 and the mounting surface 30. For example, assume that the abrasive-belt 28 has a circumference of 100 inches with a 4% stretch factor. Allowing 1% stretch to remain in order to remove the belt from the working surface, the optimal diameter of the grinding wheel frame 19 measured from the perimeter edge 31 of the mounting surface 30 will be 31.80 inches and the optimal diameter of the frame 19 measured from the textured working surface 29 will be 32.75 inches (31.80 inches plus 3% thereof).

Figure 7:
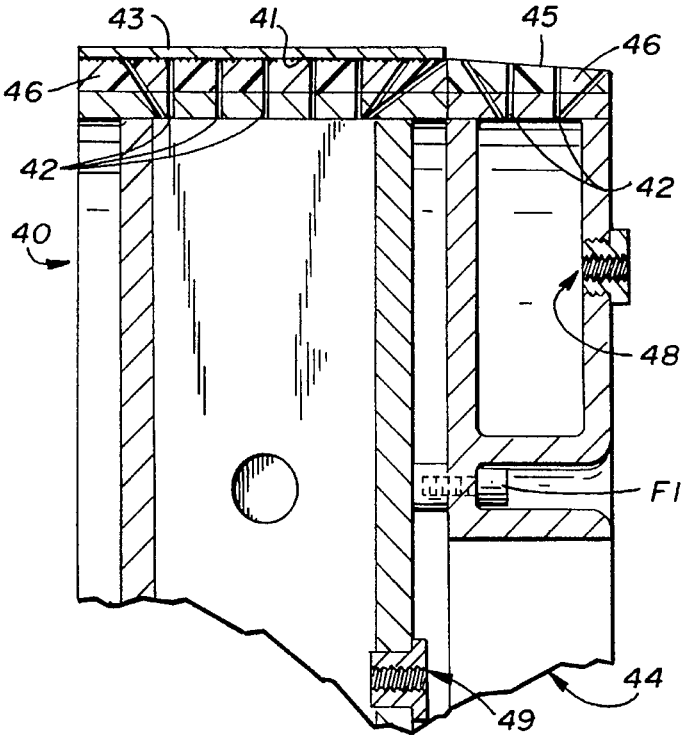
FIG. 7 is an enlarged cross-sectional view of a portion of an alternate form of the invention utilizing a removable mounting surface.
Figure 8:
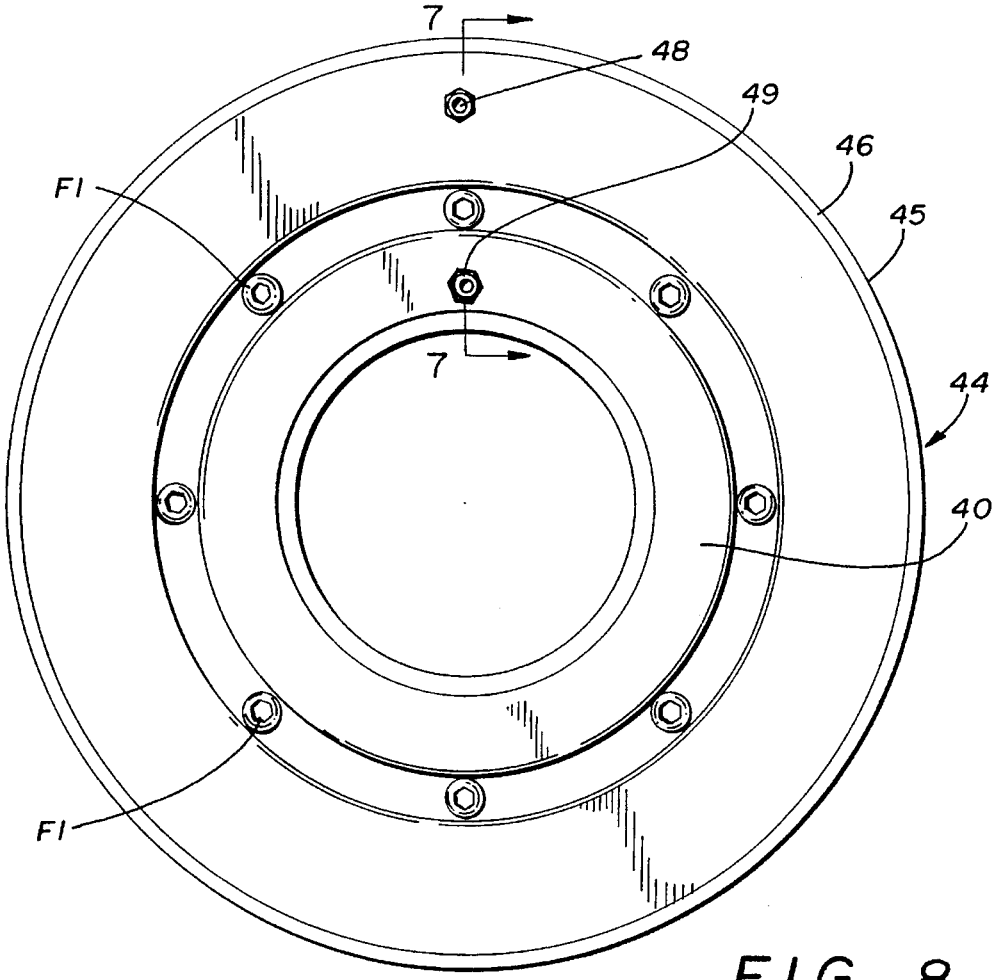
FIG. 8 is a side elevation of the removable mounting surface illustrated in FIG. 7.

FIGS. 7 and 8 disclose an alternate abrasive-belt wheel frame 40 having a similar construction as hereinbefore described of an abrasive-belt conversion grinding wheel frame 19, but with an extended working surface 41 (similar to mounting surface 29). The alternate abrasive-belt conversion wheel frame 40 thus allows for a wider abrasive-belt 43 to be used. To mount the abrasive-belt 43, an auxiliary detachable transition wheel fitting 44 having a tapered mounting surface 45 (similar to said mounting surface 30) is removably secured to the outer surface of the alternate abrasive-belt conversion wheel frame 40 by a plurality of threaded fasteners F1, as will be well understood by those skilled in the art.

The tapered mounting surface 45 is aligned with the extended working surface 41 thereby providing a transitional surface as the abrasive-belt 43 stretches. Both the textured working surface 41 and the tapered mounting surface 45 have a plurality of apertures 42 and a synthetic resin layer 46 the same as hereinbefore described which allows the abrasive-belt 43 to be frictionally secured thereto.

Pressurized fluid, such as compressed air or other gas, is applied to the abrasive-belt conversion grinding wheel frame 40 and the transition wheel fitting 44 by an inlet pressure fittings 48 and 49. The abrasive-belt 43 is slid over the mounting surface 45 and then onto the working surface 41 as the fluid escaping through the apertures 42 provide pressure to the underside of the abrasive-belt 43, as previously described. Once the abrasive-belt 43 is in position on the working surface 41, the fluid pressure is removed from the abrasive-belt conversion grinding wheel frame 40 and the abrasive-belt 43 contracts and is frictionally secured to the working surface 41. The auxiliary detachable transition wheel fitting 44 is then removed completing the installation of the abrasive-belt 43 for use.

Accordingly, the above specification contains many specificities which should not be construed as limitations on the scope of the instant invention, but rather as an exemplification of the preferred embodiment thereof. It will be apparent to those skilled in the art that various changes and structural modifications may be made therein without departing from the spirit of the invention. Therefore, the scope of the instant invention should not be determined by the embodiment shown, but rather by the claims appended hereto and their legal equivalence.

Therefore, what is claimed is:

1. A grinding apparatus for a grinding machine, the grinding apparatus comprising:

a) a spindle for mounting a grinding wheel frame, the grinding wheel frame having an outer surface, the outer surface of the grinding wheel frame having a working surface and a mounting surface;

b) wheel clamping assembly for holding the grinding wheel frame to the spindle;

c) a plurality of apertures passing laterally through the outer surface of the grinding wheel frame, the apertures being spaced longitudinally and circumferentially along the outer surface;

d) an abrasive belt being diametrically undersized for the working surface of the grinding wheel frame when in unstressed condition; and e) a valve for passing fluid under pressure to the grinding wheel frame, the fluid issues radially outward from the outer surface of the grinding wheel frame through said apertures, when the abrasive belt is slid over the mounting surface of outer surface the fluid emerging from the apertures permit sliding of the abrasive belt onto the working surface.

2. The apparatus in claim 1, wherein the working surface and mounting surface comprise a synthetic resin material, and the working surface is textured.

3. The apparatus in claim 1, wherein the wheel clamping assembly centrifically balances the grinding wheel frame to the spindle.

4. The apparatus in claim 1, wherein the inlet to the grinding wheel frame is a valve and the fluid is a gas.

5. The apparatus in claim 1, wherein the working surface and mounting surface of the outer surface are abutting, the working surface has a substantially constant diameter and the mounting surface is diametrically tapered.

6. The apparatus in claim 5, wherein the mounting surface of the outer surface having at least two ends of which the respective diameters are different, whereby one end abuts the working surface and has a maximum diameter substantial equal to the diameter of the working surface, the other end having a minimum diameter.

7. The method of grinding using an abrasive belt on a grinding wheel frame, comprising:

a) mounting a grinding wheel frame on a spindle, the grinding wheel frame having an inlet for passing fluid under pressure to a chamber within the grinding wheel frame, the outer surface of the grinding wheel frame having a working surface and a mounting surface both of which have a plurality of apertures passing laterally therethrough and traversing to the chamber inside of the wheel frame, the apertures being spaced longitudinally and circumferentially along the outer surface;

b) attaching the grinding wheel frame to the spindle using a wheel clamping assembly;

c) applying fluid to the inlet of the grinding wheel frame so that the fluid issues radially outward from the outer surface of the grinding wheel frame through said apertures;

d) fitting an abrasive belt over the mounting surface of the outer surface onto the working surface of the grinding wheel frame, the abrasive belt which is diametrically smaller than the working surface of the grinding wheel frame when in unstressed condition, is diametrically stressed outward by the pressure of the fluid emerging from the apertures which causes diametrical expansion of the abrasive belt so that the abrasive belt may more easily traverses over the mounting surface onto the working surface; and f) removing the fluid to the inlet of the grinding wheel frame to allow the abrasive belt to contract onto the working surface.

8. The method in claim 7, wherein the working surface and mounting surface comprise a synthetic resin material, and the working surface is textured.

9. The method in claim 7, wherein the wheel clamping assembly centrifically balances the grinding wheel frame to the spindle.

10. The method in claim 7, wherein the inlet to the grinding wheel frame is a valve.

11. The method in claim 10, wherein the fluid is a gas.

12. A grinding wheel frame for a grinding machine, the grinding frame comprising:

a) an outer surface, the outer surface of the grinding wheel frame having a working surface and a mounting surface;

b) a plurality of apertures passing laterally through the outer surface of the grinding wheel frame, the apertures being spaced longitudinally and circumferentially along the outer surface;

c) an abrasive belt being substantially the diameter of the grinding wheel frame measured from working surface; and d) a valve for passing fluid under pressure to a chamber within the grinding wheel frame, the fluid issues radially outward from the chamber to the outer surface of the grinding wheel frame through said apertures, when the abrasive belt is slid over the mounting surface of outer surface the fluid emerging from the apertures permit sliding of the abrasive belt onto the working surface.

* * * * *